United States Patent [19]

Szekely

[11] 4,298,377

[45] Nov. 3, 1981

[54] VORTEX REACTOR AND METHOD FOR ADDING SOLIDS TO MOLTEN METAL THEREWITH

[75] Inventor: Andrew G. Szekely, Yorktown Heights, N.Y.

[73] Assignee: Union Carbide Corporation, New York, N.Y.

[21] Appl. No.: 99,583

[22] Filed: Dec. 3, 1979

[51] Int. Cl.[3] ..... C22B 9/00

[52] U.S. Cl. ..... 75/53; 75/93 R

[58] Field of Search ..... 75/53, 93 R, 61

[56] References Cited

U.S. PATENT DOCUMENTS

| | | | |
|---|---|---|---|
| 3,272,619 | 9/1966 | Sweeney | 75/65 |
| 3,779,743 | 12/1973 | Olsson | 75/49 |
| 3,846,120 | 11/1974 | Mayorcas | 75/60 |
| 4,191,563 | 3/1980 | Smartt | 75/53 |

*Primary Examiner*—P. D. Rosenberg

*Attorney, Agent, or Firm*—Lawrence G. Kastriner

[57] ABSTRACT

Method and apparatus for adding solids to molten metal by continuously feeding both the solids and the metal into a vortex forming chamber from which the mixture is discharged at the core of the vortex as a free-falling, hollow-centered stream.

5 Claims, 6 Drawing Figures

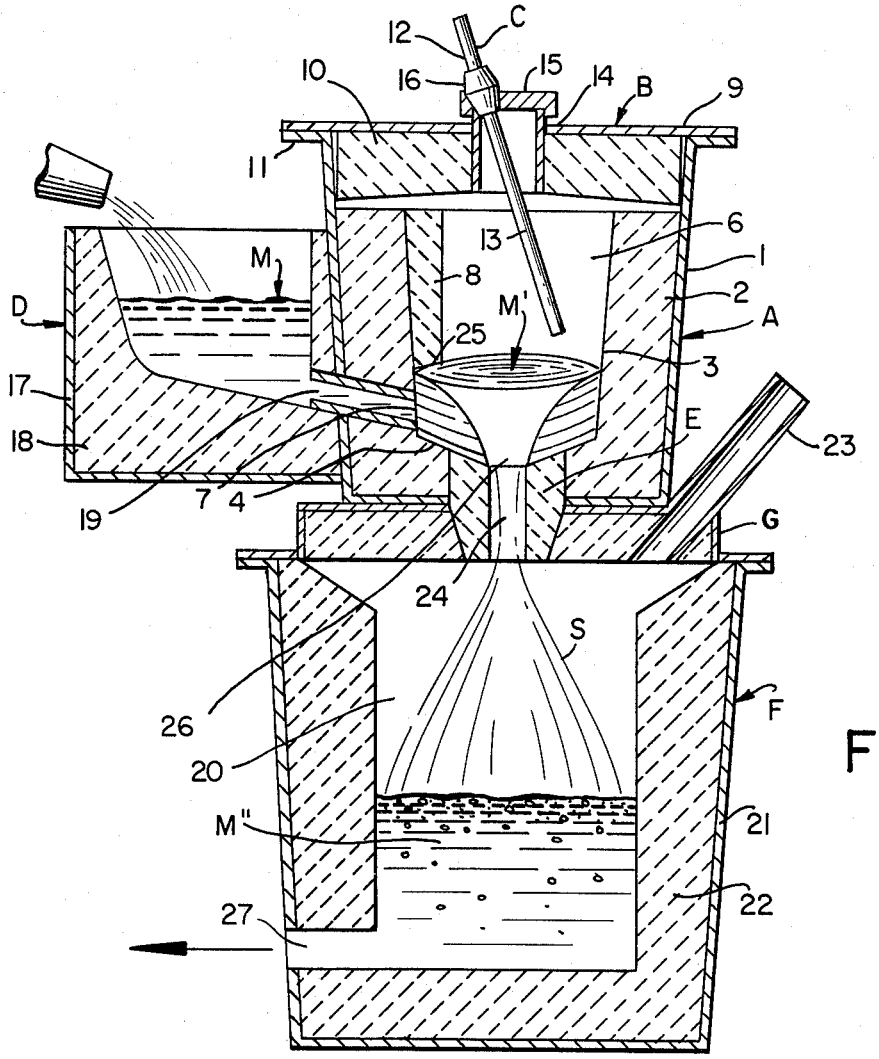
FIG. 1
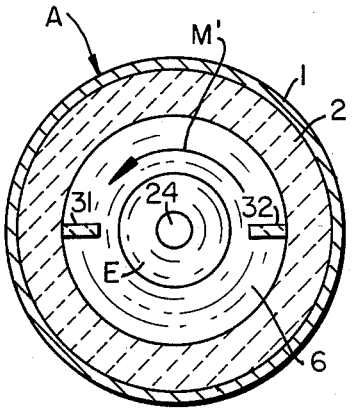
FIG. 2
FIG. 3
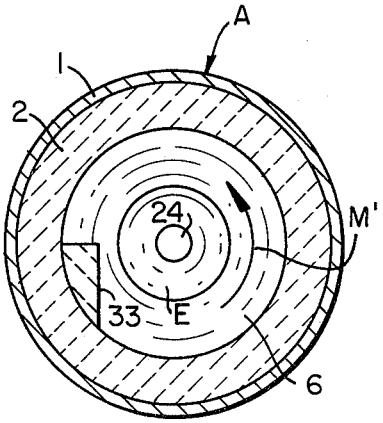
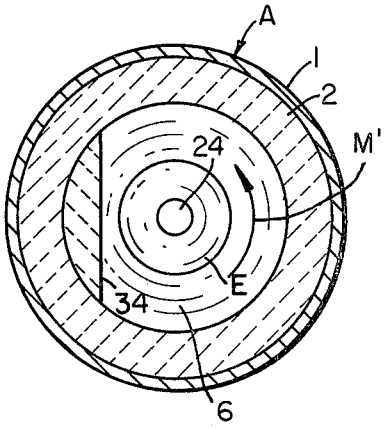
FIG. 4

VORTEX REACTOR AND METHOD FOR ADDING SOLIDS TO MOLTEN METAL THEREWITH

BACKGROUND

This invention relates to a process and apparatus for continuously feeding and uniformly dispersing solids in molten metal.

The desire to uniformly disperse solid additives in molten metal arises from the need to perform a variety of functions which such solids are capable of performing in the refining of metal. Such functions may include deoxidation, desulfurization, degassing, alloying and fluxing. For example, calcium containing material, in granular or powdered form, is added to molten steel to react with oxygen and sulfur and/or to modify the shape of inclusions, thereby improving the physical properties of the steel. Lime, $CaC_2$ or magnesium containing material are added to blast furnace iron to desulfurize the melt. In addition, during the production of steel, it is customary to adjust melt chemistry following decarburization by the addition of alloying ingredients to make the metal meet specifications.

The simplest and most common method for making such solids additions is by simply shoveling the solids into the vessel as it is being filled with the melt. One of the major difficulties encountered in treating metals with solid additives in a vessel stems from the fact that relatively small quantities of solids (for example, 100 lbs.) are normally added to very large quantities of metal (10–100 tons). In large ladles particularly, this disparity in proportions renders uniform distribution of the additive throughout the melt difficult.

A second problem encountered in dispersing solids in molten metal is one of providing sufficiently long contact time between the additive and the metal to permit the necessary heat and mass transfer to occur so that solution and reaction of the additive with the impurities in the metal may take place. Since the density of some solid additives (for example: aluminum, some ferro-silicons, calcium, lime, and magnesium) is much lower than the density of the molten metal, contact time is short due to the high buoyancy of the additive. Consequently, a significant portion of the additive may rise, and end up in the slag before it has had an opportunity to perform its intended function in the melt. This results in inefficient utilization of the additive.

A third problem occurs if the additive is highly volatile. In such case, the additive vaporizes rapidly upon coming in contact with the molten metal, and the resulting vapor bubbles have an even higher tendency to rise and escape from the metal than do solid additives. This problem is particularly severe with elements such as calcium which have low solubility in steel. With short contact times, the solution of vaporized additives requires a high vapor-melt contact area as well as high pressure. There are only limited possibilities for controlling the contact area, while the requirement of high pressure can, as a practical matter, only be satisfied by injection of the additive deep into the body of the melt.

In an attempt to solve the above-mentioned problems, the prior art has proposed a variety of techniques for feeding additives under the surface of the melt. Such methods include: introducing the solid additive into the melt in the form of a wire, shooting the solids into the metal in the form of bullets, and feeding powdery or granular additives deep into the melt through a submerged pneumatic lance. The use of the wire or bullet technique is, however, restricted to metallic additives. The use of submerged lances is subject to operational difficulties such as the formation of skulls at the slag level, excessive metal splashing and vibration of the lance caused by intensive gas bubbling. Furthermore, since pneumatic injection of solids into the metal is a batch process, it has two inherent disadvantages. First, it is necessary to superheat the melt to compensate for the heat loss during the period of additive injection; and second, the metal, if sensitive to oxidation, has to be protected from recontamination by air during teeming.

OBJECTS

It is an object of this invention to provide a method which permits feeding of solid additives into molten metal on a continuous basis, wherein the additive is uniformly dispersed throughout the melt without the necessity of using a submerged device.

It is another object of the present invention to provide apparatus which permits feeding and mixing of solid additives with molten metal in a continuous manner without an injection device submerged in the melt.

SUMMARY OF THE INVENTION

The above and other objects, which will become apparent to those skilled in the art, are achieved by the present invention one aspect of which comprises:

a method for adding solid additives to molten metal comprising: feeding a stream of molten metal continuously into a vortex forming zone in such manner that the flow of metal is caused to rotate and to form a vortex, said method being characterized by:

(1) continuously feeding the solid additive to be admixed with the metal onto the surface of the rotating metal vortex, (2) discharging the metal-additive mixture from said vortex forming zone in such manner that the mixture forms a free-falling, hollow-centered, fluid stream, and (3) collecting the discharged mixture in a receiving zone.

Another aspect of the present invention comprises: apparatus capable of continuously feeding and uniformly mixing solid additives with molten metal, comprising in combination:

(a) a refractory-lined vessel provided with a nozzle, the curved inner surface of said vessel constituting a vortex chamber, said nozzle being located in the base of the vortex chamber, (b) at least one baffle within the vortex chamber for affecting the height and intensity of the metal vortex comprising a surface opposing the rotating motion of the metal vortex, (c) a conduit for feeding molten metal into said chamber, and (d) a conduit for feeding solid additive into said chamber.

THE DRAWINGS

FIG. 1 is a cross-sectional view illustrating a preferred embodiment of apparatus in accordance with the present invention useful for adding volatile additives to metal in accordance with the method of the present invention.

FIG. 2 illustrates a top cross-sectional view of a modification of the present invention having two baffles.

FIG. 3 illustrates a top cross-sectional view of a preferred embodiment of the present invention having one baffle.

FIG. 4 illustrates an alternative form of baffle useful in the present invention which extends across the entire side wall of the vessel.

DETAILED DESCRIPTION

Figure 5:
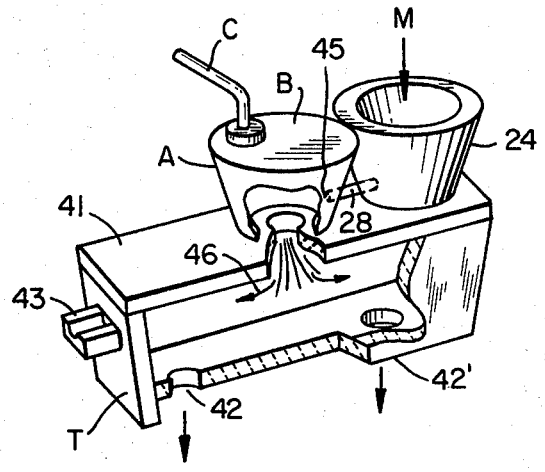
FIG. 5 illustrates use of the present invention in conjunction with a tundish for continuous casting.

The apparatus shown in FIG. 1 comprises a vortex reactor vessel A, a cover assembly therefor B, a tube C for feeding solid powdery or granular additive, a trough D for feeding metal, a discharge nozzle E, a receiving vessel F and a cover therefor G.

The vortex reactor vessel A comprises a flanged metal shell 1 provided with a refractory lining 2. The inner surface of the refractory lining 2, composed of generally cylindrical or conical side walls 3 and a base 4, forms a vortex chamber 6 such that molten metal introduced tangentially into vortex chamber 6 through inlet orifice 7 in the side wall 3 will rotate in said chamber 6, forming a vortex flow pattern with its core 26 located at the orifice of the discharge nozzle E. A baffle 8 extends down into vortex chamber 6 to control the liquid level or height and the intensity of the rotating metal M in chamber 6. Vessel A is optionally provided with a cover assembly B to make it airtight. Cover B comprises a plate 9 having a refractory lining 10. Plate 9 is bolted to flange 11 of shell 1. In order to make vessel A airtight, cover plate 9 is provided with a pipe 14 welded thereto having an upper end to which a cap 15 is sealably attached. Tube C extends through a cap 15, and for purposes of convenience, is composed of two sections 12 and 13, attached to each other by tube coupling 16.

Figure 6:
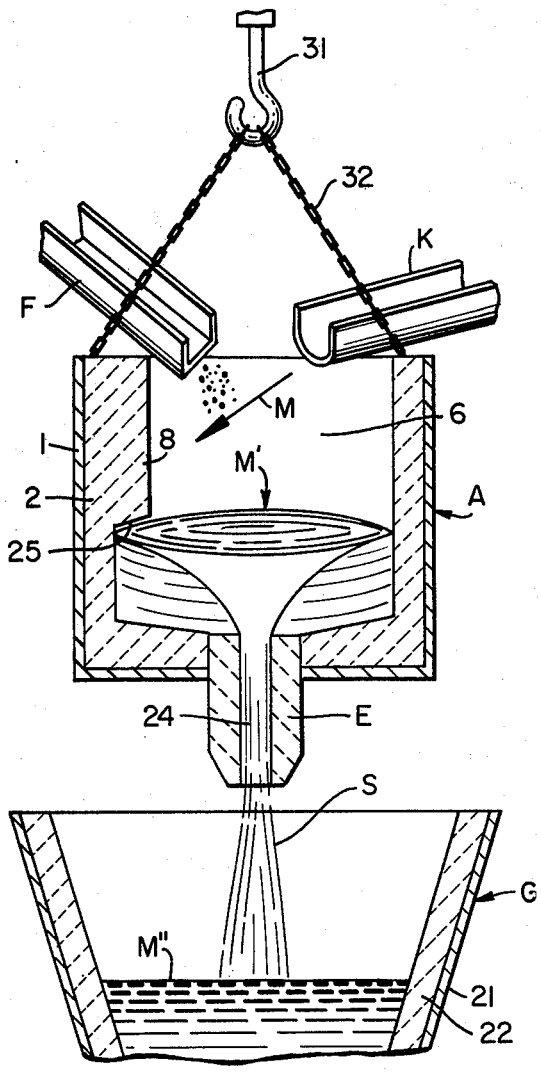
FIG. 6 illustrates another preferred embodiment of the present invention for use with non-volatile additives.

It will be understood by those skilled in the art that if a system that prevents infiltration of air is not required, for example, if the additive is not volatile or is non-reactive with air, the entire cover assembly B may be omitted, and the solids fed into the vortex chamber as shown in FIG. 6.

As shown in FIG. 1, molten metal M is fed into vortex chamber 6 from a trough D comprising a metal shell 17 having a refractory lining 18. Molten metal flows by gravity through conduit 19 and inlet orifice 7 into vortex chamber 6. Conduit 19 through refractory 2 is located at an angle which causes the metal to flow into vortex chamber 6 tangentially and below the level of the rotating metal. The base 4 of vortex chamber 6 is provided with a discharge nozzle E located at the core 26 of the vortex. Vortex chamber 6 communicates with receiving vessel F through an axial bore 24 in nozzle E. If the molten metal is steel, nozzel E is preferably made of a heat and erosion resistant refractory, such as sodium stabilized zirconia. The diameter, length and shape of bore 24, i.e., whether converging or diverging, determines both the flow capacity of the system, as well as the shape of the metal stream discharged from the vortex reactor vessel A.

In the preferred embodiment shown in FIG. 1, vessel A is fixedly attached at the bottom to cover plate G. Receiving vessel F is comprised of a metal shell 21 provided with a refractory lining 22. The type of refractory to be used therein will depend upon the type of metal for which the apparatus is to be used. By attaching cover plate G to vessel F, a system which prevents infiltration of air into the receiving vessel F is obtained. Conduit 23, which communicates with chamber 20, permits the escape of gases from vessel F to the outside atmosphere. Air will not be drawn in through conduit 23, since the pressure in chamber 20 will be slightly above atmospheric pressure due to the carrier gas blown into the system through tube C by the pneumatic addition of the solids.

In operation, molten metal M from a ladle or other source is poured into trough D, from where it flows by gravity into vortex chamber 6 through conduit 19 which causes the metal to flow in a rotating path, producing a vortex. The solid additive to be added to the metal may be introduced into vortex chamber 6 through tube C, for example, by entrainment in an inert carrier gas, with tube C directed so as to impinge the solids upon the rotating metal. The molten metal containing the additive is then discharged through nozzle E as a hollow-centered, free-falling stream S. Initially, i.e. at the start of pouring, the rate at which the metal flows out through nozzle E will be less than the rate of metal introduced into chamber 6, consequently the level of the rotating liquid M′ in chamber 6 will rise until it reaches the bottom edge 25 of baffle 8. The baffle, by interfering with the rotation of the melt and by decreasing vorticity (i.e. the strength of the vortex), increases the metal discharge rate from chamber 6 until the rates of input and output equalize at a stable metal level.

The shape of the nozzle bore 24 will determine the shape of the additive-containing metal stream S discharged from nozzle E. A moderately expanded "umbrella-shaped" discharge stream S, such as shown in FIG. 1, will be produced by a short and wide or convergent nozzle bore. Long and narrow or divergent nozzle bores will produce more compact, that is less divergent discharge streams.

The fall height and metal pouring rate should be high if intensive turbulence is to be created in the metal pool M″ by stream S. A high degree of turbulence is desirable for obtaining good mixing of any still unreacted additive with the metal, as well as for promoting agglomeration of the reaction products to facilitate subsequent slag-metal separation. The metal M″ in receiving vessel F may be discharged therefrom batch-wise or continuously, as indicated by the arrow, through discharge port 27.

A wide "umbrella-shaped" stream S is preferred if the additive is volatile, since a high gas/metal interface is produced in such a stream. That is, any vaporized additive which did not react with the metal in the vortex chamber, the discharge stream or in the pool of metal M″ in receiving vessel F, will have an opportunity to react with both the inside and outside surfaces of the "umbrella-shaped" stream S.

As noted before, a closed system such as illustrated in FIG. 1 is used if oxygen pickup by the metal or additive from the atmosphere is to be avoided. An example of such a situation is in the addition of calcium to steel. In such case, the entire apparatus should be purged with an inert gas, such as argon, before metal pouring is started.

The baffle 8 shown in FIG. 1 may be either integral with the refractory lining 2 or a separate member. Furthermore, more than one baffle may be used, and baffles may have various shapes. Each of FIGS. 2, 3 and 4 illustrate top cross-sectional views of vortex vessels as in FIG. 1 (like numbers indicating like parts) but with various baffle arrangements. In FIG. 2, two refractory baffle plates 31 and 32 are used. In FIG. 3, refractory baffle 33 is integral with the lining 2, providing a flat surface which opposes the rotating motion of the metal vortex indicated by arrow M'. FIG. 4 illustrates an alternative shape for a refractory baffle 34 which extends across the entire side wall of the vessel; hence forming a flat side wall portion of the lining 2. It will be understood that the baffle 34, like all the other baffles, extends down into the vortex chamber 6 only part way, specifically to the desired level of the metal vortex. Each of the baffles described in FIGS. 1–4 functions in the same manner to maintain the desired level of rotating metal in the vortex chamber, i.e. by interfering with the rotation of the melt and decreasing vorticity.

FIG. 5 illustrates use of the vortex reactor vessel A in conjunction with a multi-strand casting tundish for feeding two streams of molten metal to a continuous casting machine (not shown). Vortex reactor vessel A, such as illustrated in FIG. 1, having a cover assembly B and a solid additive feed tube C is attached at its base to the cover 41 of tundish T. Tundish T is a conventional refractory-lined metal shell provided with two orifices 42 and 42' for discharging streams of metal, indicated by the arrows, which feed a continuous caster. Tundish T is also provided with a metal overflow port 43, that also permits gases to escape from the tundish.

In operation, molten metal M is poured either continuously or intermittently into open ladle 24 which acts as a reservoir to provide a continuous flow of metal to vortex reactor vessel A, and hence to the tundish for casting. A sufficiently high level of metal is kept in the ladle so that metal inlet orifice 45 in vessel A is kept submerged. Conduit 28 communicates with and feeds metal to reactor vessel A. Metal from the ladle enters vortex reactor A through orifice 45, forming a metal vortex as previously described. Solid additive is mixed with the metal vortex by injection through inlet tube C. The metal-additive mixture is discharged from vortex reactor A through a nozzle in its base as previously described, with the discharge stream indicated by the arrows 46 falling into tundish T.

FIG. 6 illustrates use of a vortex reactor vessel A, such as previously described, in combination with an open top receiving vessel G. This type of arrangement may be used if the solid additive is not volatile and the metal not sensitive to contamination by air. Metal M, as indicated by the arrow, is fed into vortex vessel A through feed trough K and solids are fed through chute F. The metal-additive mixture is discharged from vessel A through an elongated discharge nozzle E as a compact stream S which is collected in receiving vessel G. For ease of handling, vessel A may be conveniently transported by a crane (not shown). Vessel A is hung from crane hook 31 by chain 32.

EXAMPLE

The following example will serve to illustrate the manner in which the present method is carried out as well as operation of the apparatus. The apparatus used was such as that illustrated in FIG. 1. The entire system was purged with argon prior to initiation of metal flow. The specific calcium additive used was a commercially available Ca-Si-Ba-Al alloy containing 10% Ca. Molten steel was poured from an induction furnace into the trough portion of the vortex reactor vessel, and the trough was kept sufficiently filled so that the discharge orifice from the trough was kept submerged. The molten steel was introduced into the vortex chamber tangentially through a conduit in the refractory lining of the chamber as shown in FIG. 1. The powdered additive was fed through the feed tube, using argon as the fluidizing or carrier gas, at the rate of 0.4 cubic feet per minute (0.7 $m^3$/hr.) and was blown onto the surface of the rotating metal vortex in the chamber. Molten metal was fed into the vortex chamber at the rate of 23 short tons (21 metric tons) per hour and the discharged metal-additive mixture was collected in a closed receiving vessel as shown in FIG. 1. Pouring of metal was stopped when the receiving vessel was $\frac{3}{4}$ full. The metal in the receiving vessel was then sampled and analyzed. Metallographic analysis of the samples taken indicated that the desired complexing of the alumina inclusions in the metal with calcium had been satisfactorily achieved.

The present invention has a number of advantages over processes and apparatus known in the prior art for contacting solids with molten metal. The present invention provides a continuous process which can easily be integrated into a variety of steel refining operations. For example, it can be integrated into a continuous casting line for purposes of adding alloying elements to the molten steel just prior to casting. Another advantage of the present invention is that it can be used to supply additives directly into the metal without the interference of either slag or gas bubbles. Intimate contact between the solid additive and the metal is established as soon as the solids impinge upon the rotating metal, and further contact by vaporized additive is obtained in the discharge jet. The present invention permits accurate feeding and mixing of the solid additive with the metal, in contrast to the localized feeding of solid additives in a ladle where the mixing and distribution of the additive is a function of the metal flow pattern developed in the ladle. Simplicity of operation and low capital investment are further advantages of the present invention.

What is claimed is:

1. A method for adding solid additives to molten metal comprising: feeding a stream of molten metal continuously into a vortex forming zone in such manner that the flow of metal in said zone is caused to rotate and to form a hollow-centered vortex, said method being characterized by:

(1) continuously feeding the solid additive to be admixed with the metal onto the surface of the rotating metal vortex, (2) discharging the metal-additive mixture from said vortex forming zone in a controlled manner such that the mixture forms a free-falling, hollow-centered fluid stream, said stream remaining hollow-centered for its entire length, and (3) collecting the discharged mixture in a receiving zone.

2. The method of claim 1, wherein the feed rate of solid additive is dependent upon the flow rate of the metal fed to the vortex forming zone.

3. The method of claim 1, wherein the height and intensity of said vortex is controlled by baffle means opposing the rotating motion of said vortex.

4. The method of claim 1, wherein the hollow-centered discharge stream is a diverging stream.

5. The method of claim 4, wherein the solid additive is highly volatile, and wherein the volatilized additive is absorbed at least in part by the hollow diverging stream of falling metal.

* * * * *